US010593297B2

(12) United States Patent
Lee et al.

(10) Patent No.: US 10,593,297 B2
(45) Date of Patent: Mar. 17, 2020

(54) TIMING CONTROLLER, DISPLAY DEVICE USING THE SAME AND METHOD OF DRIVING THE DISPLAY DEVICE

(71) Applicant: LG Display Co., Ltd., Seoul (KR)

(72) Inventors: Sanghoon Lee, Paju-si (KR); Seungtae Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 176 days.

(21) Appl. No.: 15/659,887

(22) Filed: Jul. 26, 2017

(65) Prior Publication Data

US 2018/0033404 A1 Feb. 1, 2018

(30) Foreign Application Priority Data

Jul. 29, 2016 (KR) ..... 10-2016-0096768

(51) Int. Cl.

| | |
|---|---|
| ***G09G 3/30*** | (2006.01) |
| ***G09G 5/18*** | (2006.01) |
| ***G09G 3/34*** | (2006.01) |
| ***G09G 5/395*** | (2006.01) |
| ***G09G 3/3275*** | (2016.01) |
| ***G09G 3/3233*** | (2016.01) |
| ***G09G 3/3266*** | (2016.01) |
| ***G09G 3/20*** | (2006.01) |

(52) U.S. Cl.

CPC ..... *G09G 5/18* (2013.01); *G09G 3/2074* (2013.01); *G09G 3/2096* (2013.01); *G09G 3/3233* (2013.01); *G09G 3/3266* (2013.01); *G09G 3/3275* (2013.01); *G09G 3/3406* (2013.01); *G09G 5/395* (2013.01); *G09G 2300/0426* (2013.01); *G09G 2300/0842* (2013.01); *G09G 2300/0861* (2013.01); *G09G 2310/0281* (2013.01); *G09G 2310/08* (2013.01); *G09G 2320/0252* (2013.01); *G09G 2320/045* (2013.01); *G09G 2320/0673* (2013.01); *G09G 2330/021* (2013.01); *G09G 2340/0407* (2013.01); *G09G 2340/0457* (2013.01)

(58) Field of Classification Search

None

See application file for complete search history.

(56) References Cited

U.S. PATENT DOCUMENTS

2002/0008682 A1* 1/2002 Park ..... G09G 3/20 345/87

* cited by examiner

*Primary Examiner* — Joseph R Haley

(74) *Attorney, Agent, or Firm* — Morgan, Lewis & Bockius LLP

(57) ABSTRACT

The present disclosure provides a timing controller, a display device using the same, and a method of driving the display device. The display device includes a display panel displaying an image, at least two data drivers supplying a data signal to the display panel, at least two slave timing controllers that control the at least two data drivers, respectively, and supply the data signal to the at least two data drivers, respectively, and a master timing controller that controls the at least two slave timing controllers and that itself splits an externally supplied data signal and distributes the same to the at least two slave timing controllers.

10 Claims, 14 Drawing Sheets image shift: Image shift with respect to origin

| Orbit mode | Ctrl [3bit] | |
|---|---|---|
| Up | 4 | ← Selection 2 |
| Down | 3 | ← Selection 1 |
| Left | 2 | |
| Right | 1 | |

TIMING CONTROLLER, DISPLAY DEVICE USING THE SAME AND METHOD OF DRIVING THE DISPLAY DEVICE

This application claims the priority benefit of Korean Patent Application No. 10-2016-0096768 filed on Jul. 29, 2016, which is hereby incorporated herein by reference for all purposes as if fully set forth herein.

BACKGROUND

Technical Field

The present invention relates to a timing controller, a display device using the same, and a method of driving the display device.

Discussion of the Related Art

The market for displays which act as an intermediary between users and information is growing with the development of information technology. Thus, display devices such as organic light-emitting displays (OLEDs), electrophoretic display devices (EDs), liquid crystal displays (LCDs), and plasma display panels (PDPs) are increasingly used.

A display device comprises a display panel comprising a plurality of subpixels and a drive part that drives the display panel. The drive part comprises a scan driver that supplies a scan signal (or gate signal) to the display panel and a data driver that supplies a data signal to the display panel. When a scan signal, a data signal, etc. are supplied to subpixels, the selected subpixels emit light, thereby allowing the display device to display an image.

On the display panel, the subpixels are implemented based on devices, such as thin-film transistors that are formed on a substrate by deposition. When devices such as thin-film transistors are driven for a long time, this causes degradation, like a threshold voltage shift or a decrease in lifetime. When device degradation occurs, the luminance characteristics of the display panel which displays images based on these devices change too.

To prevent device degradation, driving and compensation schemes for smoothing out degradation concentrated on particular subpixels have been proposed. However, such driving and compensation schemes cannot be directly applied to a display device with a large screen and high resolution, which needs improvement.

SUMMARY

Accordingly, embodiments of the present disclosure are directed to a timing controller, a display device using the same, and a method of driving the display device that substantially obviate one or more of the problems due to limitations and disadvantages of the related art.

Features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display device comprises a display panel displaying an image; at least two data drivers supplying a data signal to the display panel; at least two slave timing controllers that control the at least two data drivers, respectively, and supply the data signal to the at least two data drivers, respectively; and a master timing controller that controls the at least two slave timing controllers and that itself splits an externally supplied data signal and distributes the same to the at least two slave timing controllers.

In another aspect, a method of driving a display device comprises an image distribution step of splitting a data signal supplied to a master timing controller and distributing the same to at least two slave timing controllers; an image output step of supplying the data signal distributed to the at least two slave timing controllers to at least two data drivers; and an image display step of outputting the data signal supplied to the at least two data drivers to a display panel, wherein, in the image distribution step, an input data signal is split into at least two according to a degradation compensation mode configured in the master timing controller, and part of the split data signals is assigned to one or the other of the at least two slave timing controllers according to the degradation compensation mode.

In yet another aspect, a timing controller comprises an image splitting part that splits an externally supplied data signal into at least two; an image distribution part that distributes and outputs at least two split data signals under control of the image splitting part; a first image output part that receives a first data signal from the image distribution part and outputs the same to one of the at least two slave timing controllers; and a second image output part that receives a second data signal from the image distribution part and that outputs the same to the other one of the at least two slave timing controllers.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Reference will now be made in detail to embodiments of the invention, examples of which are illustrated in the accompanying drawings.

Hereinafter, a concrete example according to an exemplary embodiment of the present invention will be described with reference to the accompanying drawings.

A display device according to the present invention is implemented as a television, a video player, a personal computer (PC), a home theater, etc. A display panel of the display device may be, but not limited to, a liquid-crystal display panel, an organic light-emitting display panel, an electrophoretic display panel, a plasma display panel, etc. For convenience of explanation, an organic light-emitting display device based on an organic light-emitting display panel will be described as an example.

Figure 1:
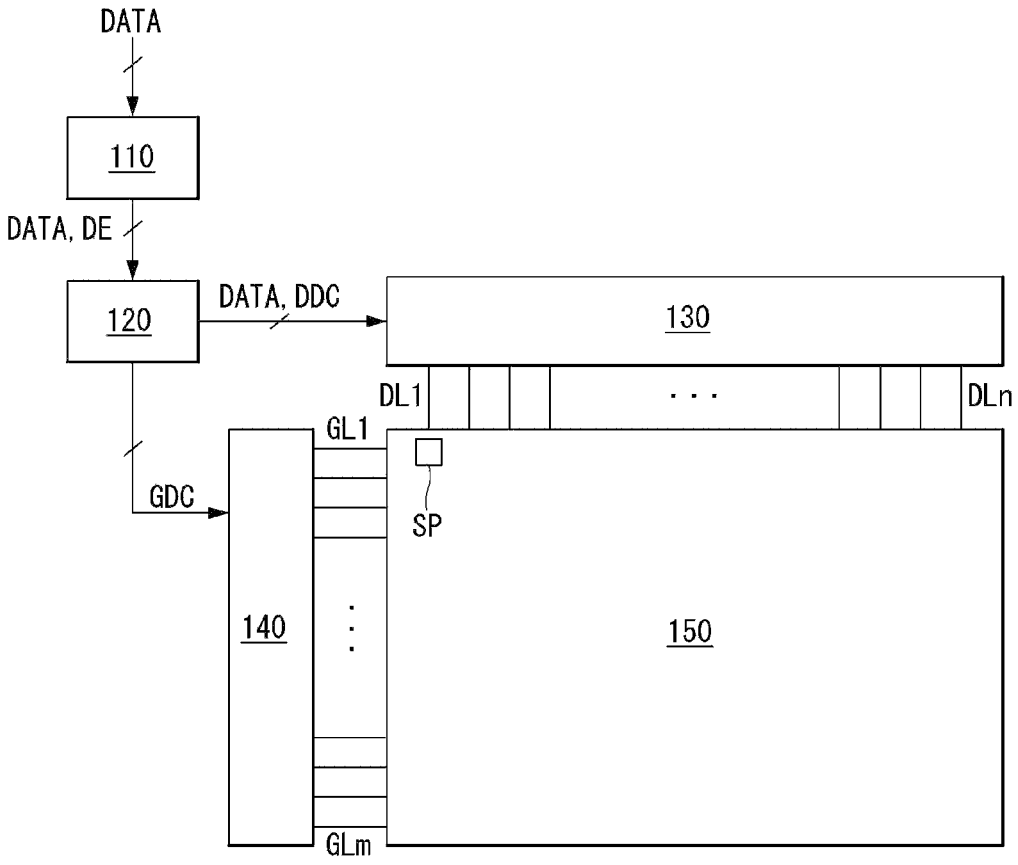
FIG. 1 is a schematic block diagram of an organic light-emitting display device according to an exemplary embodiment of the present invention.
Figure 2:
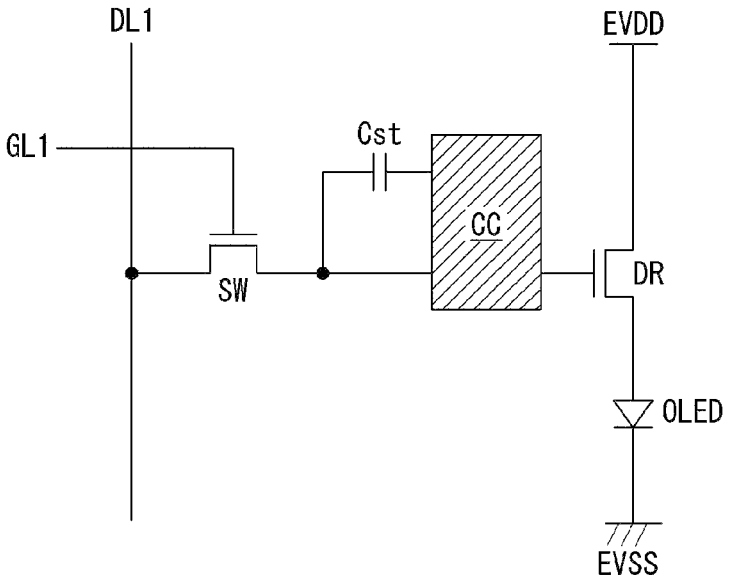
FIG. 2 is a schematic circuit diagram of a subpixel.
Figure 3:
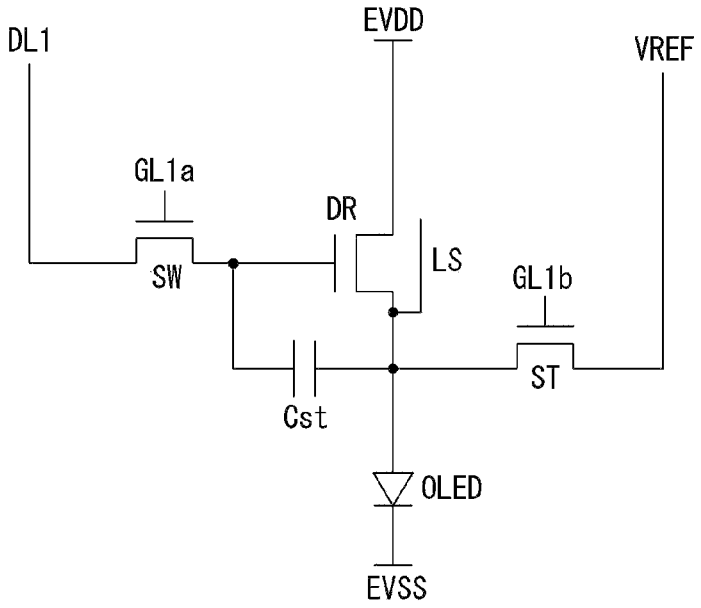
FIG. 3 is an illustration of a circuit configuration of a subpixel according to an exemplary embodiment of the present invention.
Figure 4:
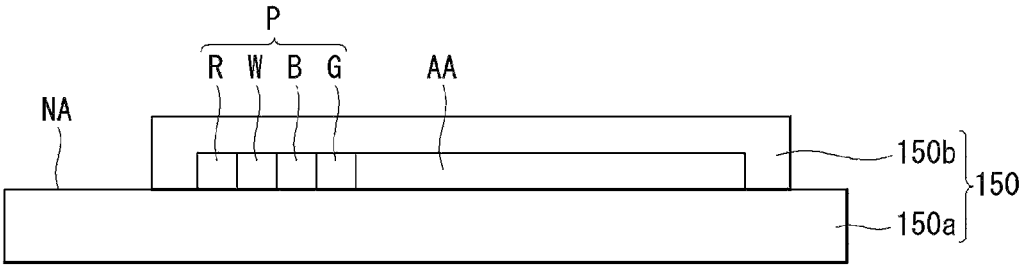
FIG. 4 is an illustration of a cross-section of a display panel according to an exemplary embodiment of the present invention.
Figure 5:
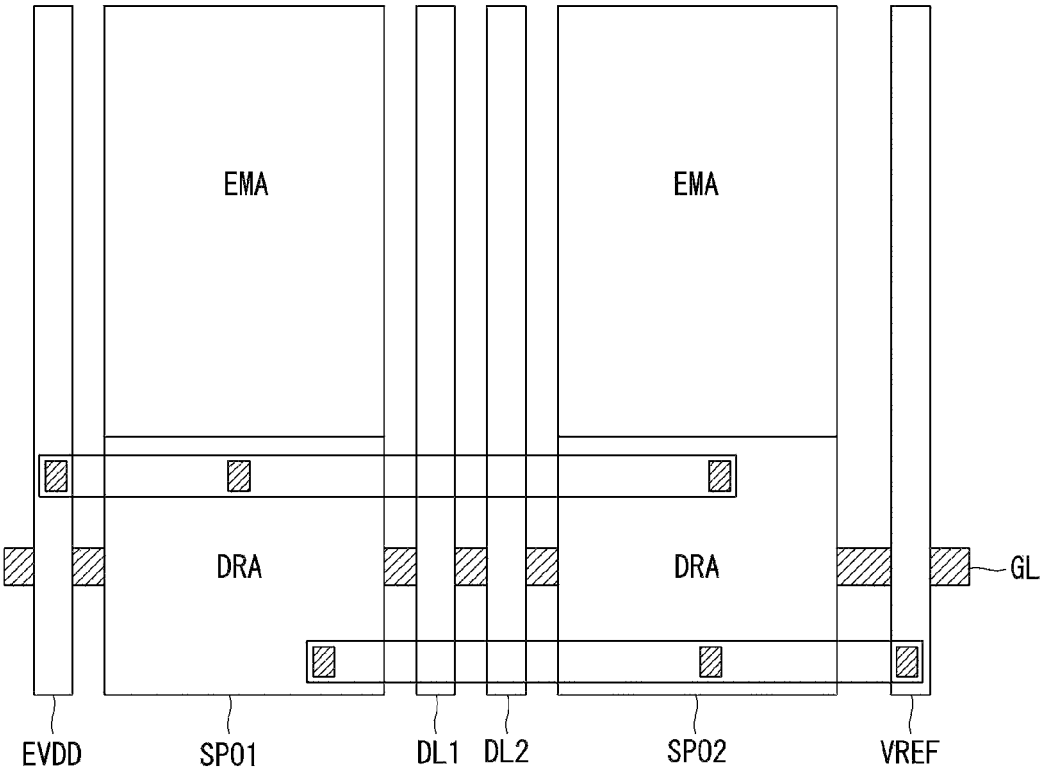
FIG. 5 is an illustration of a plane of a subpixel according to an exemplary embodiment of the present invention.

FIG. 1 is a schematic block diagram of an organic light-emitting display device according to an exemplary embodiment of the present invention. FIG. 2 is a schematic circuit diagram of a subpixel. FIG. 3 is an illustration of a circuit configuration of a subpixel according to an exemplary embodiment of the present invention. FIG. 4 is an illustration of a cross-section of a display panel according to an exemplary embodiment of the present invention. FIG. 5 is an illustration of a plane of a subpixel according to an exemplary embodiment of the present invention.

As illustrated in FIG. 1, an organic light-emitting display device according to an exemplary embodiment of the present invention comprises an image processor 110, a timing controller 120, a data driver 130, a scan driver 140, and a display panel 150.

The image processor 110 outputs a data enable signal DE, etc., along with an externally supplied data signal DATA. In addition to the data enable signal DE, the image processor 110 may output one or more among a vertical synchronization signal, a horizontal synchronization signal, and a clock signal. But, these signals will be omitted in the drawings for convenience of explanation.

The timing controller 120 receives the data signal DATA from the image processor 110, along with the data enable signal DE or driving signals including the vertical synchronization signal, horizontal synchronization signal, and clock signal. The timing controller 120 outputs a gate timing control signal GDC for controlling the operation timing of the scan driver 140 and a data timing control signal DDC for controlling the operation timing of the data driver 130, based on the driving signals.

The data driver 130 samples and latches the data signal DATA supplied from the timing controller 120, in response to the data timing control signal DDC supplied from the timing controller 120, and converts this signal to a gamma reference voltage and outputs it. The data driver 130 outputs the data signal DATA through data lines DL1 to DLn. The data driver 130 may be provided in the form of an IC (integrated circuit).

The scan driver 140 outputs a scan signal while shifting the level of a gate voltage in response to the gate timing control signal GDC supplied from the timing controller 120. The scan driver 140 outputs a scan signal through scan lines GL1 to GLm. The scan driver 140 is provided in the form of an IC (integrated circuit), or provided on the display panel 150 in the form of a gate-in-panel.

The display panel 150 displays an image in response to the data signal DATA and scan signal respectively supplied from the data driver 130 and scan driver 140. The display panel 150 comprises subpixels SP that work to display an image.

The subpixels SP may comprise red subpixels, green subpixels, and blue subpixels, or may comprise white subpixels, red subpixels, green subpixels, and blue subpixels. The subpixels SP may have one or more different light-emission areas depending on the light-emission characteristics.

As illustrated in FIG. 2, one subpixel comprises a switching transistor SW, a driving transistor DR, a capacitor Cst, a compensation circuit CC, and an organic light-emitting diode OLED.

The switching transistor SW acts as a switch in response to a scan signal supplied through the first scan line GL1 to store a data signal supplied through the first data line DL1 as a data voltage in the capacitor Cst. The driving transistor DR works to cause a drive current to flow between a first power supply line EVDD and a second power supply line EVSS by the data voltage stored in the capacitor Cst. The organic light-emitting diode OLED works to emit light by the drive current formed by the driving transistor DR.

The compensation circuit CC is a circuit that is added within the subpixel to compensate for a threshold voltage, etc. of the driving transistor DR. The compensation circuit CC consists of one or more transistors. The configuration of the compensation circuit CC varies widely depending on the method of compensation, and an example thereof will be described below.

As illustrated in FIG. 3, the compensation circuit CC comprises a sensing transistor ST and a sensing line VREF. The sensing transistor ST is connected to a second electrode line, for example, a source line of the driving transistor DR and an anode (hereinafter, "sensing node") of the organic light-emitting diode OLED. The sensing transistor ST may operate to supply a reset voltage (or sensing voltage) delivered through the sensing line VREF to the sensing node or sense the voltage or current in the sensing node.

The switching transistor SW has a first electrode connected to a first data line DL1 and a second electrode connected to a gate electrode of the driving transistor DR. The driving transistor DR has a first electrode connected to the first power supply line EVDD and a second electrode connected to the anode of the organic light-emitting diode OLED. The capacitor Cst has a first electrode connected to the gate electrode of the driving transistor DR and a second electrode connected to the anode of the organic light-emitting diode OLED. The organic light-emitting diode OLED has the anode connected to the second electrode of the driving transistor DR and a cathode connected to the second power supply line EVSS. The sensing transistor ST has a first electrode connected to the sensing line VREF and a second electrode connected to the anode, i.e., sensing node, of the organic light-emitting diode OLED.

The operating time of the sensing transistor ST may be similar/equal to that of the switching transistor SW or different from it, depending on the compensation algorithm (or the compensation circuit configuration). The switching transistor SW may have a gate electrode connected to a la scan line GL1*a*, and the sensing transistor ST may have a gate electrode connected to a 1b scan line GL1*b*. In another example, the 1a scan line GL1*a* connected to the gate electrode of the switching transistor SW and the 1b scan line GL1*b* connected to the gate electrode of the sensing transistor ST may be commonly connected so as to be shared.

The sensing line VREF may be connected to the data driver. In this case, the data driver may sense the sensing node of the subpixel in real time, during a non-display period of an image or for an N-th frame period (N is an integer of 1 or greater), and may generate a sensing result. The switching transistor SW and the sensing transistor ST may be turned on simultaneously. In this case, a sensing operation through the sensing line VREF and a data output operation of outputting a data signal may be done separately based on a time-division system of the data driver.

Targets to be compensated for according to the sensing result may include a digital data signal, an analog data signal, or a gamma voltage. The compensation circuit, which generates a compensation signal (or compensation voltage) based on the sensing result, may be implemented as an internal circuit of the data driver, as an internal circuit of the timing controller, or as a separate circuit.

A light blocking layer LS may be disposed only below a channel region of the driving transistor DR, or may be disposed below channel regions of the switching transistor SW and sensing transistor ST, as well as below the channel region of the driving transistor DR. The light blocking layer LS may be used simply for the purpose of blocking ambient light, or the light blocking layer LS may be used as an electrode that facilitates a connection with other electrodes or lines and forms a capacitor, etc.

FIG. 3 illustrates, by way of example, a subpixel having a 3-transistors/1-capacitor (3T1C) structure comprising the switching transistor SW, the driving transistor DR, the capacitor Cst, the organic light-emitting diode OLED, and the sensing transistor ST. However, when a compensation circuit CC is added, the sub-pixel may be configured to have a 3T2C, 4T2C, 5T1C, or 6T2C structure.

As illustrated in the FIG. 4, subpixels are formed in a display area AA of a first substrate 150*a*, based on the circuit explained with reference to FIG. 3. The subpixels formed in the display area AA are sealed by a protective film (or a protective substrate) 150*b*. The unexplained part NA refers to a non-display area. The first substrate 150*a* may be made with glass or ductile material.

The subpixels may be horizontally or vertically arranged in the display area AA, for example, in order of red (R), white (W), blue (B), and green (G) colors. The red, white, blue, and green subpixels R, W, B, and G may form a single pixel P. However, the sequence of the subpixels may be altered in various ways depending on emitting materials, light-emission areas, the compensation circuit configuration (or structure), and so on. Also, the red, blue, and green subpixels R, B, and G may form a single pixel P.

As illustrated in FIGS. 4 and 5, a 01st subpixel SP01 and 02th subpixel SP02 each having an emitting area EMA and a circuit area DRA may be formed in the display area AA. The first power supply line EVDD may be positioned to the left of the 01st subpixel SP01, a sensing line VREF may be positioned to the right of the 02th subpixel SP02, and first and second data lines DL1 and DL2 may be positioned between the 01st subpixel SP01 and the 02th subpixel SP02.

The 01st subpixel SP01 may be electrically connected to the first power supply line EVDD positioned to the left thereof, the first data line DL1 positioned to the right thereof, and the sensing line VREF positioned to the right of the 02th subpixel SP02. The 02th subpixel SP02 may be electrically connected to the first power supply line EVDD positioned to the left of the 01st subpixel SP01, the second data line DL2 positioned to the left thereof, and the sensing line VREF positioned to the right thereof.

In the 01st subpixel SP01 and the 02th subpixel SP02, organic light-emitting diodes positioned in the emitting areas EMAs may emit light in response to operations of the switching and driving transistors positioned in the circuit areas DRAs.

On the display panel, the subpixels are implemented based on devices such as thin-film transistors formed on a substrate by deposition. When devices such as thin-film transistors are driven for a long time, this causes degradation, like a threshold voltage shift or a decrease in lifetime. When device degradation occurs, the luminance characteristics of the display panel which displays images based on these devices change too.

Conventionally, to prevent device degradation, driving and compensation schemes for smoothing out degradation concentrated on particular subpixels or were proposed. However, the conventional driving and compensation schemes cannot be directly applied to a display device with a large screen and high resolution, which needs improvement.

Hereinafter, a text example for solving the problems occurring in the related art and an exemplary embodiment of the present invention for solving a problem with the test example will be described.

Test Example

Figure 6:
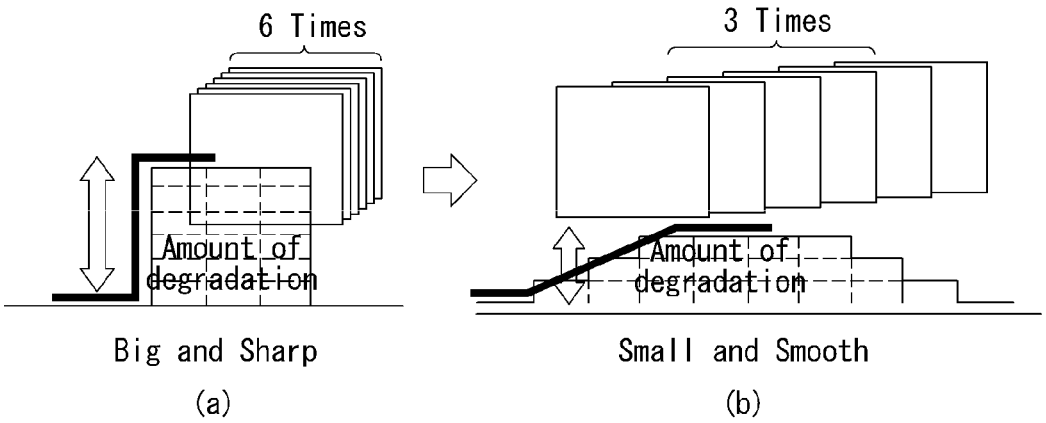
FIGS. 6 and 7 are views explaining an example of a degradation compensation scheme.
Figure 7:
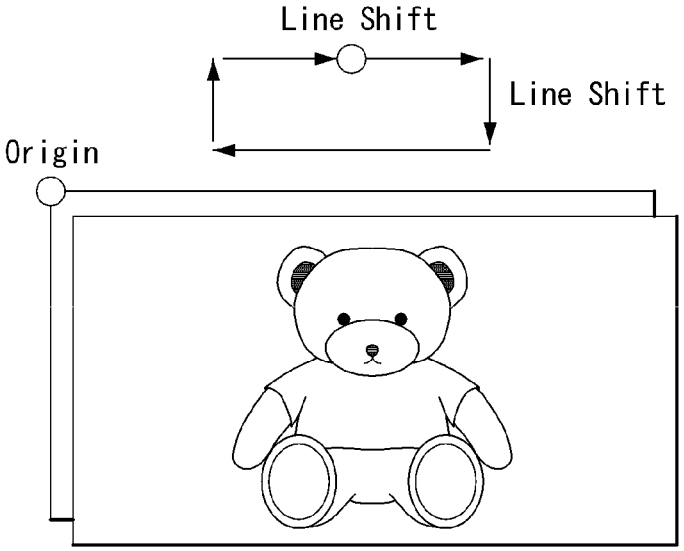
Figure 8:
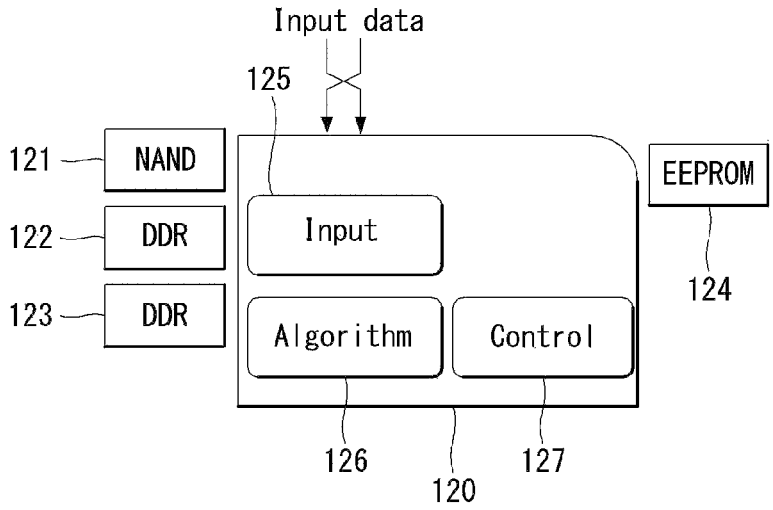
FIG. 8 is a diagram of a timing controller.
Figure 9:
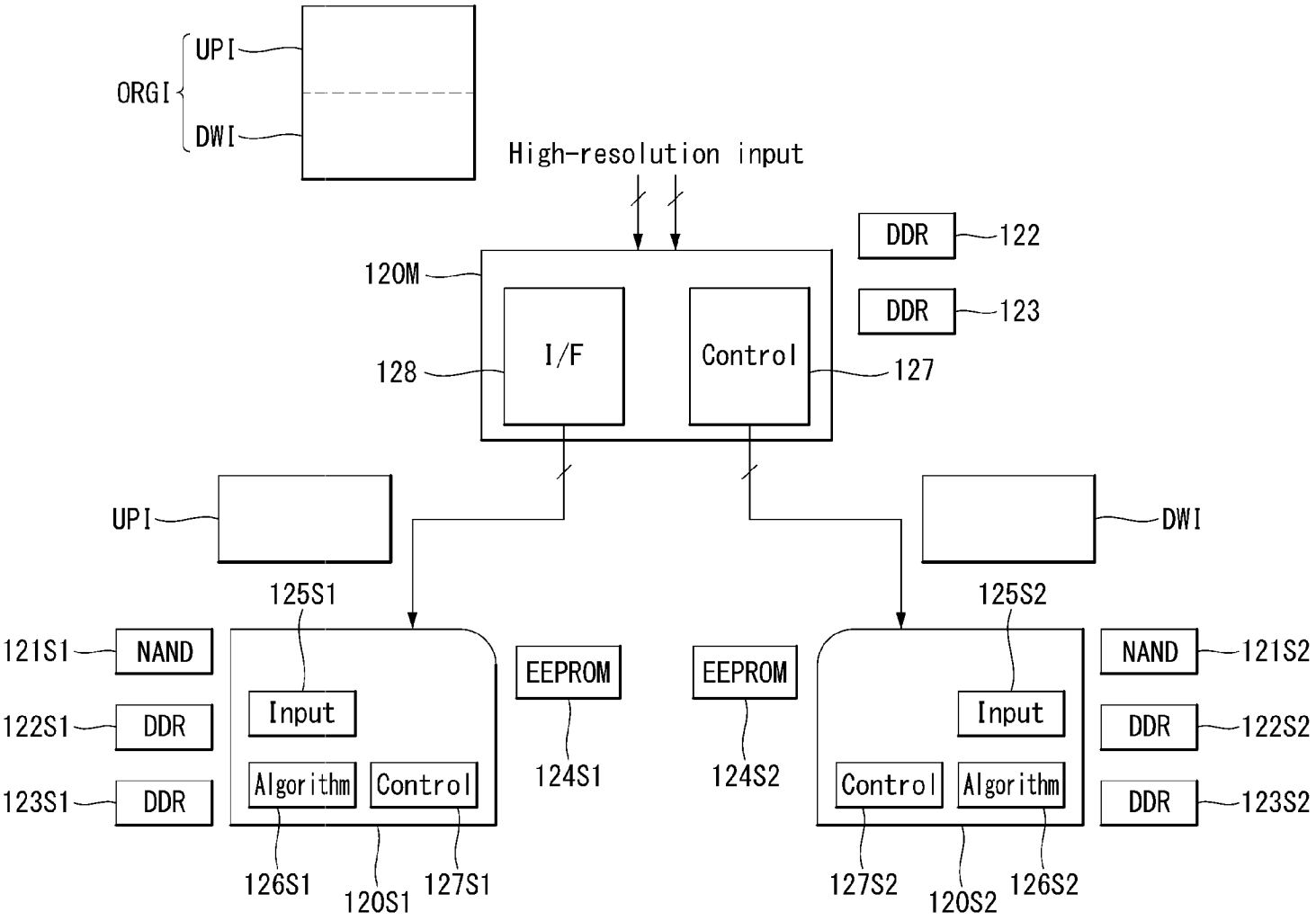
FIG. 9 is a block diagram schematically showing some of the components of a high-resolution display device implemented according to a test example.
Figure 10:
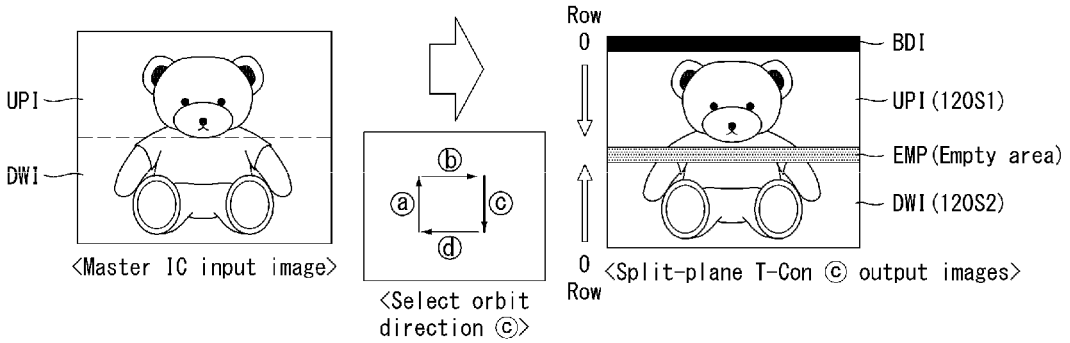
FIGS. 10 and 11 are views explaining a problem with the test example.
Figure 11:
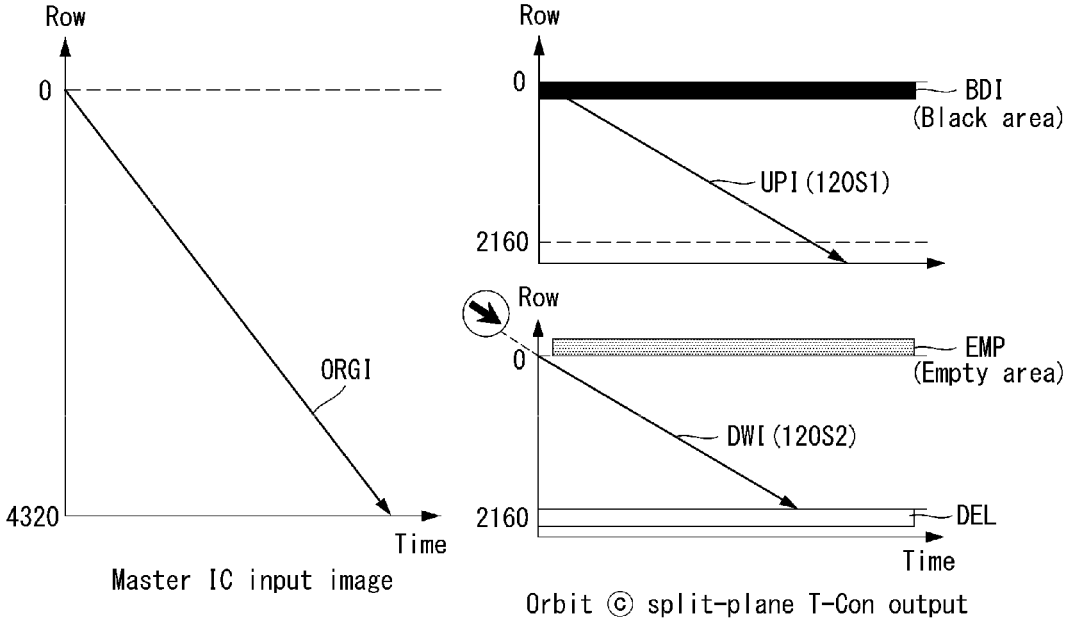

FIGS. 6 and 7 are views explaining an example of a degradation compensation scheme. FIG. 8 is a diagram of a timing controller. FIG. 9 is a block diagram schematically showing some of the components of a high-resolution display device implemented according to a test example. FIGS. 10 and 11 are views explaining a problem with the test example.

As illustrated in FIG. 6, a scheme of processing a big and sharp data signal ((a) of FIG. 6) into a small and smooth data signal ((b) of FIG. 6) was conventionally proposed in order to prevent device degradation.

As illustrated in FIG. 7, an orbital shift method was conventionally proposed in which the direction a data signal is displayed with respect to the origin designated on the display panel for a set amount of time (or given amount of time) is shifted by a certain distance, i.e., the data signal is a variation, in order to prevent device degradation.

As illustrated in FIG. 8, the timing controller 120 conventionally proposed comprises an image input part 125 that receives an externally supplied data signal, an algorithm part 126 that performs compensation on an input data signal, and a control part 127 that outputs a compensated data signal and various control signals.

The timing controller 120 conventionally proposed operates in conjunction with various types of memories 121 to 124. The memories 121 to 124 may comprise a first memory 121 of NAND flash-type, a second memory 122 of double data rate (DDR)-type, a third memory 123 of double data rate (DDR)-type, and a fourth memory 124 of erasable programmable read-only (EEPROM)-type.

In order to perform compensation as in FIG. 7, the conventionally proposed timing controller 120 performs the following operation. When a data signal is input, the timing controller 120 writes the input data signal to the memories 122 and 123 serving as frame memory.

Next, under control of the algorithm part 126 and the control part 127, the timing controller 120 retrieves the stored data signal and then outputs it after shifting by a certain distance the direction the data signal is displayed with respect to the origin designated on the display panel. The data signal may be shifted line by line (line shift). The shift direction and sequence may be set according to internal settings in the timing controller 120 or according to user settings.

Meanwhile, if a display device is implemented as a high-resolution display device, image data signals also increase due to the increased resolution. For this reason, a split-plane driving scheme is required which can split and drive frame-by-frame data signals to display on the display panel, and the corresponding timing controllers T-con and drivers are needed.

In the test example shown in FIG. 9, a high-resolution display device is implemented to perform compensation as in FIG. 7 based on the conventionally proposed timing controller 120. The high-resolution display device of the test example is implemented based on a master timing controller 120M serving as a master and slave timing controllers 120S1 and 120S2 serving as slaves to be controlled by the master.

The slave timing controllers 120S1 and 120S2 are implemented by the configuration explained with reference to FIG. 8. On the other hand, the master timing controller 120M comprises a control part 127 that reads and writes an externally supplied data signal to the memories 122 and 123 and that controls an interface part 128, and the interface part 128 that splits a data signal and outputs separate signals to the slave timing controllers 120S1 and 120S2. The interface part 128 splits a data signal and outputs separate signals to supply to the slave timing controllers 120S1 and 120S2, under control of the control part 127.

The master timing controller 120M serves to supply a first data signal UPI for an upper image through the first slave timing controller 120S1 and a second data signal DWI for a lower image through the second slave timing controller 120S2.

The master timing controller 120M of FIG. 9 is configured to only have a function of distributing and supplying an externally supplied data signal to the slave timing controllers 120S1 and 120S2, in order to reduce the cost that may be incurred to configure a display device.

Consequently, the master timing controller 120M may omit and delete the algorithm part, NAND flash memory, and erasable programmable read-only memory, apart from the double data rate (DDR)-type memories used for data signal distribution.

In the high-resolution display device as in the test example, the direction a data signal is displayed with respect to the origin designated on the display panel for a set amount of time (or given amount of time) is shifted by a certain distance by the orbital shift method of FIG. 10, in order to prevent device degradation. In the orbital shift method, data signals are shifted by a certain distance from bottom to top ⓐ, from left to right ⓑ, from top to bottom ⓒ, and from right to left ⓓ.

However, when the high-resolution display device as in the test example implements the orbital shift method to prevent device degradation, an empty area EMP may be created between two images, where no image appears due to an output inconsistency between the upper image (UPI) 120S1 and the lower image (DWI) 120S2, as illustrated in FIG. 10.

A study of the problem with the test example revealed that, as shown in FIG. 11, the problem arose because an operation for implementing the orbital shift method was performed while the data signals were fixed after the original image ORGI output from the master timing controller (master IC) was supplied to the slave timing controllers. This will be described more concretely below.

The orbital shift method is implemented in the direction ⓒ (towards the bottom of the display panel). The original image ORGI is output from the master timing controller, and the slave timing controllers each receive and store it in memory.

According to the orbital shift method, the first slave timing controller and the second slave timing controller shift the data signals for the upper image (UPI) 120S1 and lower image (DWI) 120S2 towards the bottom of the display panel. Accordingly, black data BDI is inserted into first to N lines (N is an integer of 2 or greater) of the upper image (UPI) 120S1. The black data BDI is inserted into the portion from which the data signals are shifted, in the region displayed on the display panel as the data signals are shifted.

On the contrary, first to Nth lines (N is an integer of 2 or greater) of the lower image (DWI) 120S2 remain as an empty area EMP. Also, there is a deleted area DEL after the last line of the lower image (DWI) 120S2 since the data signals are shifted. The deleted area DEL is not displayed on the display panel.

The first slave timing controller and the second slave timing controller receive the data signals for the upper image (UPI) 120S1 and lower image (DWI) 120S2 from the master timing controller, and shift the data signals for given lines and output them according to the orbital shift method.

In the test example, the master timing controller did not take into consideration the data signal variation resulting from the orbital shift method implemented by the first slave timing controller and second slave timing controller. This means that the test example cannot handle the data signal shift region (the variation due to the shift of the data signals). Therefore, the test example needs to resolve this problem in order to implement the orbital shift method.

Exemplary Embodiments

Figure 12:
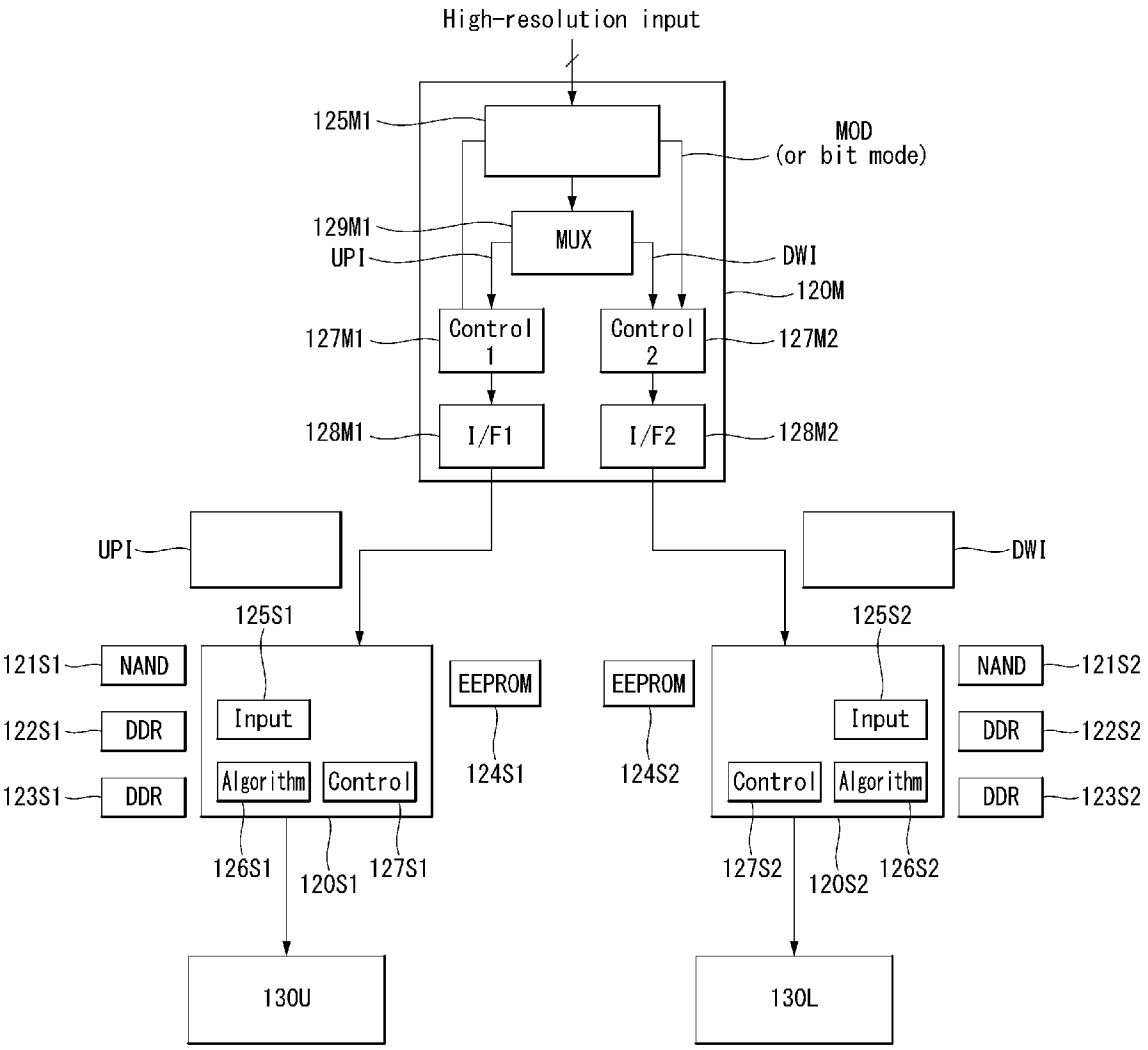
FIG. 12 is a block diagram schematically showing some of the components of a high-resolution display device implemented according to a first exemplary embodiment of the present invention.
Figure 13:
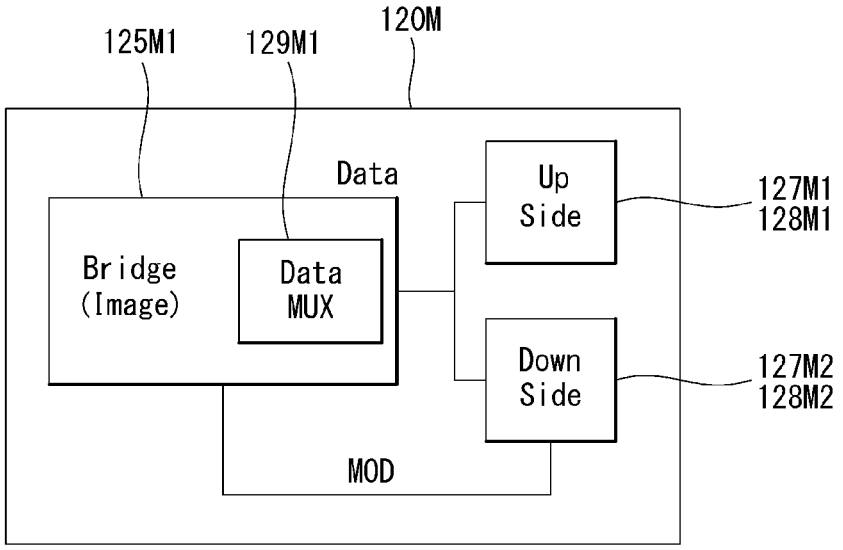
FIG. 13 is a block diagram schematically showing some of the components of a high-resolution display device implemented according to a second exemplary embodiment of the present invention.
Figure 13:
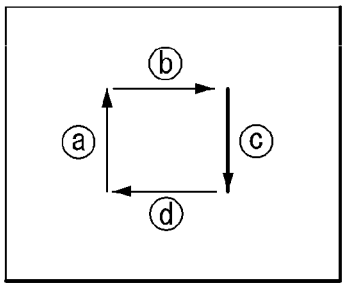
Figure 14:
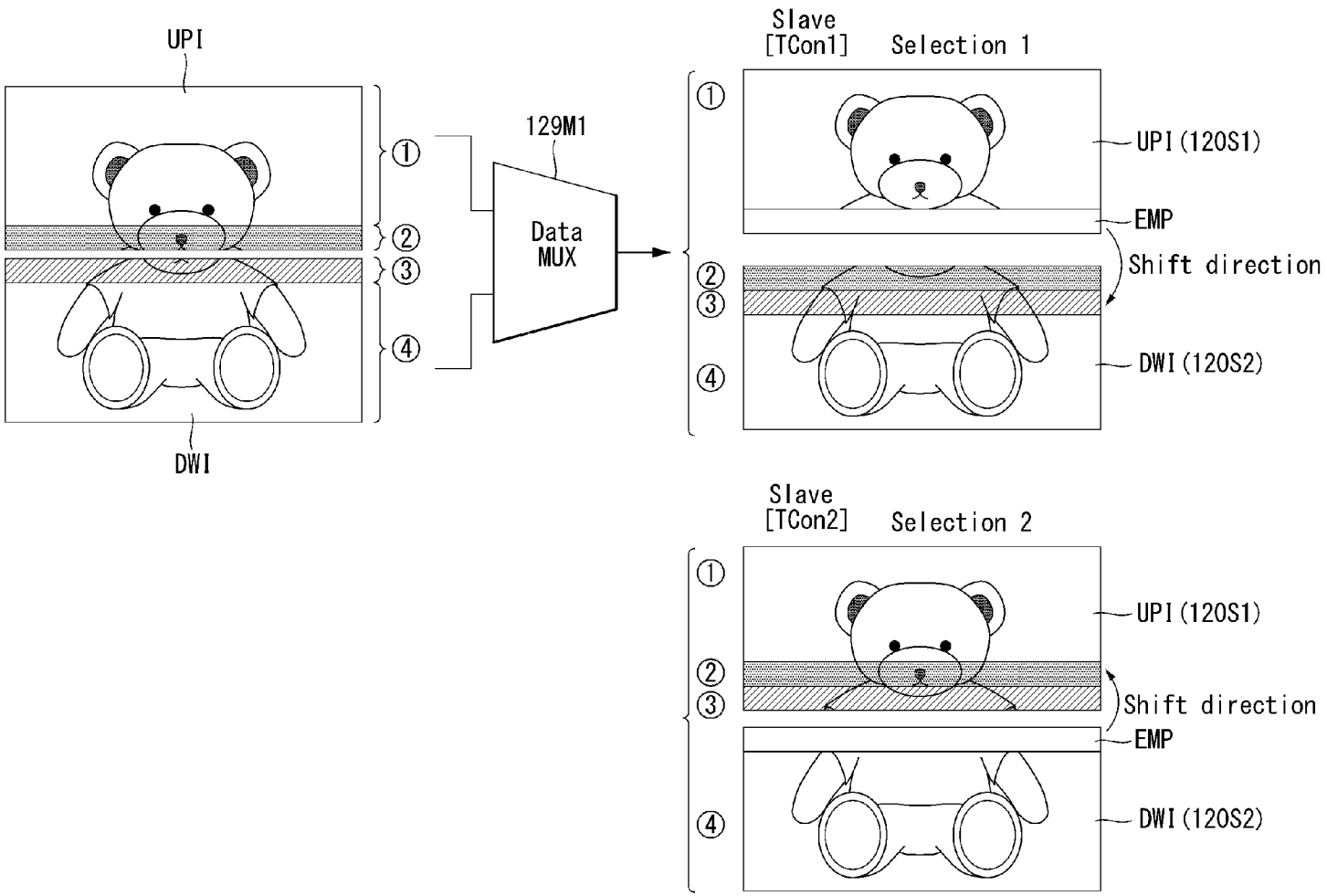
FIG. 14 is a view explaining operations of a master timing controller and slave timing controllers implemented according to the first and second exemplary embodiments of the present invention.

FIG. 12 is a block diagram schematically showing some of the components of the high-resolution display device implemented according to a first exemplary embodiment of the present invention. FIG. 13 is a block diagram schematically showing some of the components of a high-resolution display device implemented according to a second exemplary embodiment of the present invention. FIG. 14 is a view explaining operations of a master timing controller and slave timing controllers implemented according to the first and second exemplary embodiments of the present invention.

As illustrated in FIG. 12, the high-resolution display device according to the first exemplary embodiment of the present invention is implemented based on a master timing controller 120M serving as a master and slave timing controllers 120S1 and 120S2 serving as slaves to be controlled by the master.

The master timing controller 120M comprises an image splitting part 125M1, an image distribution part 129M1, a first image control part 127M1, a first interface part 128M1, a second image control part 127M2, and a second interface part 128M2.

The image splitting part 125M1 generates a mode control signal MOD according to an internally-configured degradation compensation mode, and splits an externally supplied data signal into M (M is an integer of 2 or greater) and outputs separate signals based on the mode control signal. Once the mode control signal MOD is determined and generated, the image splitting part 125M1 itself splits a data signal between the upper and lower halves or left and right halves of the image displayed on the display panel and outputs separate signals. In this case, the upper and lower halves or left and right halves of the image displayed on the display panel are defined relative to a virtual center line provided within the image splitting part 125M1. The virtual center line is determined according to the degradation compensation mode. For example, when the image is split into upper and lower regions, the virtual center line is horizontal, and when the image is split into left and right regions, the virtual center line is vertical.

The image splitting part 125M1 controls the image distribution part 129M1 in response to a mode control signal MOD. In an example below, the degradation compensation mode, which is one of the modes in the orbital shift method, is implemented towards the bottom of the display panel (see the direction ⓒ of FIG. 10). Also, in the example, the image splitting part 125M1 itself splits an externally supplied data signal into two and outputs separate signals. The number of segments into which a data signal is split corresponds to the number of slave timing controllers.

The image distribution part 129M1 distributes two data signals UPI and DWI for the upper image (UPI) 120S1 and lower image (DW1) 120S2 to the first image control part 127M1 and second image control part 127M2, under control of the image splitting part 125M1. The image distribution part 129M1 may be implemented as a time-division multiplexer MUX or an algorithm that performs such an operation. The image distribution part 129M1 supplies the two data signals UPI and DWI directly to the first image control part 127M1 and second image control part 127M2 by a time-division system, so that the use of memory can be avoided.

The first image control part 127M1 controls output from the first interface part 128M1 in response to a mode control signal MOD supplied from the image splitting part 125M1. The first interface part 128M1 outputs a first data signal UPI for the upper image (UPI) 120S1 under control of the first image control part 127M1. The first data signal UPI output from the first interface part 128M1 is supplied to the first slave timing controller 120S1. The first interface part 128M1 may be implemented as a communication part that enables data communication.

The second image control part 127M2 controls output from the second interface part 128M2 in response to a mode control signal MOD supplied from the image splitting part 125M1. The second interface part 128M2 outputs a second data signal DWI for the lower image (DWI) 120S2 under control of the second image control part 127M2. The second data signal DWI output from the second interface part 128M2 is supplied to the second slave timing controller 120S2. The second interface part 128M2 may be implemented as a communication part that enables data communication.

The first and second slave timing controllers 120S1 and 120S2 comprise image input parts 125S1 and 125S2 that receive data signals supplied from the first and second interface parts 128M1 and 128M2, algorithm parts 126S1 and 126S2 that perform compensation on input data signals, and control parts 127S1 and 127S2 that output compensated data signals and various control signals.

The first and second slave timing controllers 120S1 and 120S2 operate in conjunction with various types of memories 121S1 to 124S1 and 121S2 to 124S2. The memories 121S1 to 124S1 and 121S2 to 124S2 may comprise first memories 121S1 and 121S2 of NAND flash type, second memories 122S1 and 122S2 of double data rate (DDR) type, third memories 123S1 and 123S2 of double data rate (DDR) type, and fourth memories 124S1 and 124S2 of erasable programmable read-only (EEPROM) type.

The first slave timing controller 120S1 performs image processing on the first data signal UPI output from the first interface part 128M1 and supplies it to a first data driver 130U. The second slave timing controller 120S2 performs image processing on the second data signal DWI output from the second interface part 128M2 and supplies it to a second data driver 130L.

The first and second slave timing controllers 120S1 and 120S2 perform a compensation operation for shifting data signals towards the bottom of the display panel, including inserting black data BDI into first to Nth lines (N is an integer of 2 or greater) of the upper image (UPI) 120S1, in response to a mode control signal MOD supplied from the master timing controller 120M.

The black data BDI is inserted into the portion from which the data signals are shifted, in the region displayed on the display panel as the data signals are shifted. The black data BDI may correspond to the top edge, bottom edge, left edge, or right edge of the display panel depending on where the data signals are shifted from.

According to the first exemplary embodiment, the master timing controller 120M itself may split and distribute a data signal to supply to the first and second slave timing controllers 120S1 and 120S2, in response to a mode control signal MOD. Accordingly, the master timing controller 120M may omit and delete the double data rate (DDR) memories used in the test example.

As illustrated in FIG. 13, according to the second exemplary embodiment of the present invention, the components and functions of some of the blocks included in the master timing controller 120M may be integrated. For example, the image distribution part 129M1 may be incorporated into the image splitting part 125M1. The first image control part 127M1 and the first interface part 128M1 may be integrated into a first image output part that controls the upper image Up Side, and the second image control part 127M2 and the second interface part 128M2 may be integrated into a second image output part that controls the lower image Down Side.

The image splitting part 125M1 may select an orbit mode for preventing device degradation and generate a mode control signal. Mode control signals for different orbit modes and their bit values may be set as follows.

The bit value of a mode control signal for shifting data signals from bottom to top (ⓐ, Up) may be set to 4, the bit value of a mode control signal for shifting data signals from top to bottom (ⓒ, Down) may be set to 3, the bit value of a mode control signal for shifting data signals from right to left (ⓓ, Left) may be set to 2, and the bit value of a mode control signal for shifting data signals from left to right (ⓑ, Right) may be set to 1.

As illustrated in FIG. 14, when a data signal is externally supplied, the master timing controller splits the data signal between an upper region ① displayed on the upper portion of the display panel and a lower region ④ displayed on the lower portion of the display panel, according to the degradation compensation mode. In this case, the master timing controller may first set shift regions ② and ③ existing between the upper and lower regions ① and ④ and then separate the upper and lower regions ① and ④ with respect to the shift regions ② and ③, according to the degradation compensation mode. Also, the master timing controller may first set the upper and lower regions ① and ④ and then separate the shift regions ② and ③ existing between the upper and lower regions ① and ④ with respect to the upper and lower regions ① and ④, according to the degradation compensation mode.

I horizontal lines (I is an integer of 2 or greater) of data signals are assigned to the first and second shift regions ② and ③. The first and second shift regions ② and ③ each have the same number of horizontal lines of data signals. The data signals in each of the first and second shift regions ② and ③ may be included in the lower region ④ or the upper region ①, according to the degradation compensation mode.

Now, operations (data signal input-output) of the master timing controller and slave timing controllers implemented according to the first and second exemplary embodiments of the present invention will be described below with respect to a mode (selection 1) for shifting data signals from top to bottom and a mode (selection 2) for shifting data signals from bottom to top.

—Mode (Selection 1) for Shifting Data Signals from Top to Bottom—

When the mode for shifting data signals from top to bottom is selected, the image distribution part 129M1 of the timing controller outputs the data signals of the upper region ① to the first slave timing controller TCon1. Also, the image distribution part 129M1 of the timing controller assigns and outputs the data signals of the first and second shift regions ② and ③, along with those of the lower region ④, to the second slave timing controller TCon2.

Accordingly, the data signals of the upper region ① become the upper image (UPI) 120S1 the first slave timing controller TCon1 will control, and the data signals of the first and second shift regions ② and ③ and the data signals of the lower region ④ become the lower image (DWI) 120S2 the second slave timing controller TCon2 will control.

Meanwhile, an empty area EMP corresponding to the first shift region ② is created in the data signals of the upper image (UPI) 120S1 supplied to the first slave timing controller TCon1. However, this empty area EMP will be filled with the overlying data signals since the data signals are shifted according to the degradation compensation scheme. Black data is inserted into another empty area (near the first line of the upper image) created by the data signal shift.

—Mode (Selection 2) for Shifting Data Signals from Bottom to Top—

When the mode for shifting data signals from bottom to top is selected, the image distribution part 129M1 of the timing controller assigns and outputs the data signals of the first and second shift regions ② and ③, along with those of the upper region CD, to the first slave timing controller TCon1. Also, the image distribution part 129M1 of the timing controller outputs the data signals of the lower region ④ to the second slave timing controller TCon2.

Accordingly, the data signals of the first and second shift regions ② and ③ and the data signals of the upper region CD become the upper image (UPI) 120S1 the first slave timing controller TCon1 will control, and the data signals of the lower region ④ become the lower image (DWI) 120S2 the second slave timing controller TCon2 will control.

Meanwhile, an empty area EMP corresponding to the second shift region ③ is created in the data signals of the lower image (DWI) 120S2 supplied to the second slave timing controller TCon2. However, this empty area EMP will be filled with the underlying data signals since the data signals are shifted according to the degradation compensation scheme. Black data is inserted into another empty area (near the last line of the lower image) created by the data signal shift.

Hereinafter, driving characteristics (particularly, the type of memory used) of the first and second slave timing controllers in the mode (selection 1) for shifting data signals from top to bottom will be described.

Figure 15:
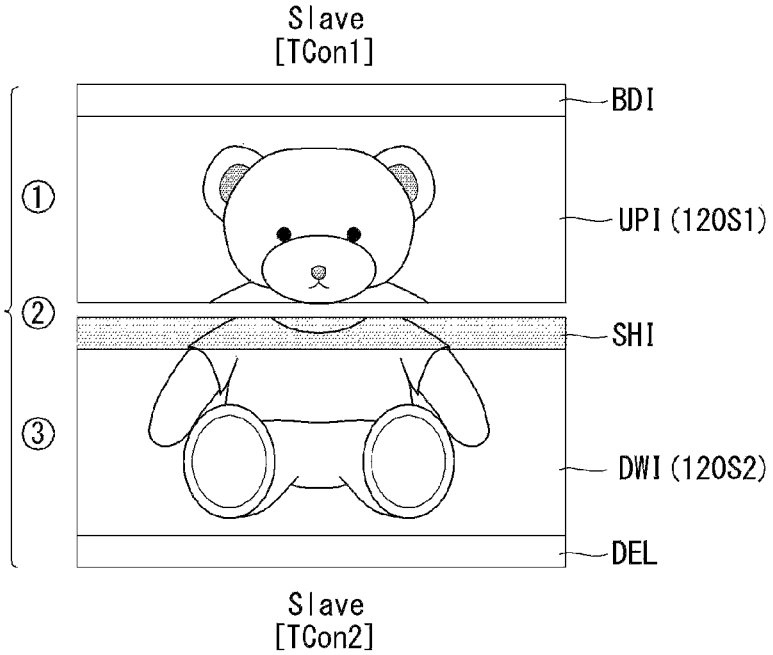
FIG. 15 is a view showing an image displayed on a display panel by the driving of first and second slave timing controllers.
Figure 16:
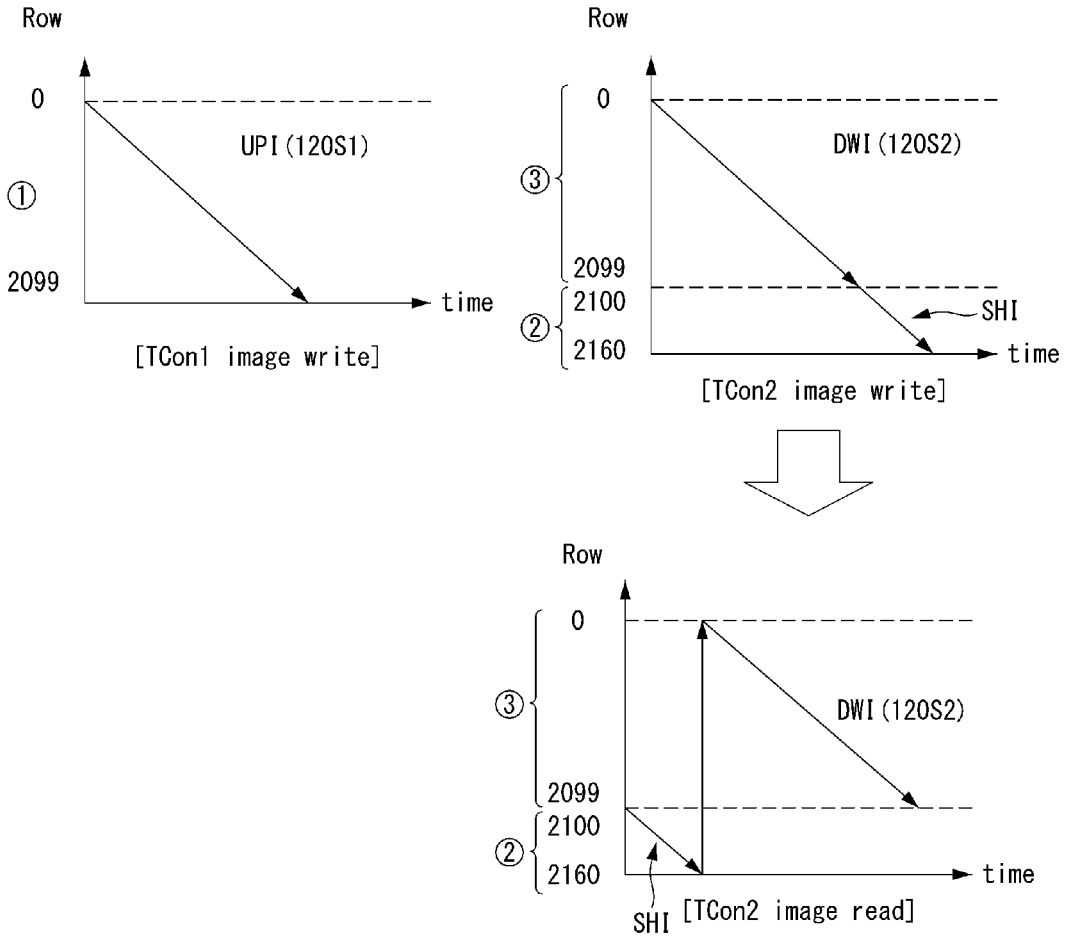
FIG. 16 is a view explaining driving characteristics of the first and second slave timing controllers.

FIG. 15 is a view showing an image displayed on a display panel by the driving of the first and second slave timing controllers. FIG. 16 is a view explaining driving characteristics of the first and second slave timing controllers.

As illustrated in FIG. 15, the first slave timing controller TCon1 outputs data signals for the upper image (UPI) 120S1. The data signals of the upper image (UPI) 120S1 are shifted downward. Due to this, the data signals of the upper image (UPI) 120S1 are output, with black data BDI being inserted in the first to Nth lines (N is an integer of 2 or greater).

The second slave timing controller TCon2 outputs data signals for the lower image (DWI) 120S2. The data signals of the lower image (DWI) 120S2 are shifted downward. The data signals of the lower image (DWI) 120S2 are output, with the empty area from the first to Nth lines (N is an integer of 2 or greater) being filled with the data signals of the shift region SHI. Meanwhile, there is a deleted area DEL near the last line since the data signals of the lower image (DWI) 120S2 are shifted. The data signals of the deleted area DEL are not displayed on the display panel.

The first slave timing controller TCon1 performs the following operation in order to display the upper image (UPI) 120S1 of FIG. 15 on the display panel. This will be described with reference to FIGS. 15 and 16.

When the data signals CD of the upper image (UPI) 120S1 are output from the master timing controller, the first slave timing controller TCon1 sequentially writes the input data signals ① of the upper image (UPI) 120S1 to its memory (see TCon1 image write).

The first slave timing controller TCon1 writes only the data signals CD of the upper image (UPI) 120S1 in a frame memory and reads the data signals when outputting them, and then shifts the data signals and outputs them after inserting black data BDI into the upper image (UPI) 120S1.

When the data signals ② and ③ of the shift region SHI and the lower image (DWI) 120S2 are output from the master timing controller, the second slave timing controller TCon2 sequentially writes the input data signals ② and ③ of the lower image (DWI) 120S2 to its memory (see TCon2 image write). As can be seen from FIG. 16, the data signals ③ of the lower image (DWI) 120S2 are supplied earlier than the data signals ② of the shift region SH1.

As above, the first and second slave timing controllers TCon1 and TCon2 sequentially write image data signals output from the master timing controller to their memory. Afterwards, the first slave timing controller TCon1 sequentially retrieves the data signals ① of the upper image (UPI) 120S1 stored in its memory and outputs the data signals after performing compensation and image processing on them.

Unlike the first slave timing controller TCon1, the second slave timing controller TCon2 non-sequentially retrieves the data signals because there is a variation due to the shift of the data signals, and outputs the data signals after performing compensation and image processing on them.

For example, the second slave timing controller TCon2 retrieves the data signals 2 of the shift region SHI first and then the data signals ③ of the lower image (DWI) 120S2, and outputs these data signals after performing compensation and image processing on them.

Once the second slave timing controller TCon2 retrieves data signals in the above order, output inconsistencies among the data signals ① of the upper image (UPI) 120S1, the data signals ② of the shift region SHI, and the data signals ③ of the lower image (DWI) 120S2 are sequentially resolved in response to a scan signal. As such, the exemplary embodiments can solve the problem (the empty area between the two images) occurring in the test example and at the same time can reduce the number of memories (for the master timing controller) compared to the test example.

Meanwhile, according to the above description, the exemplary embodiments of the present invention may vary the method and order in which image data signals are retrieved, depending on the direction in which data signals are shifted in a compensation operation.

Hereinafter, a configuration of a high-resolution display device according to a third exemplary embodiment of the present invention will be described.

Figure 17:
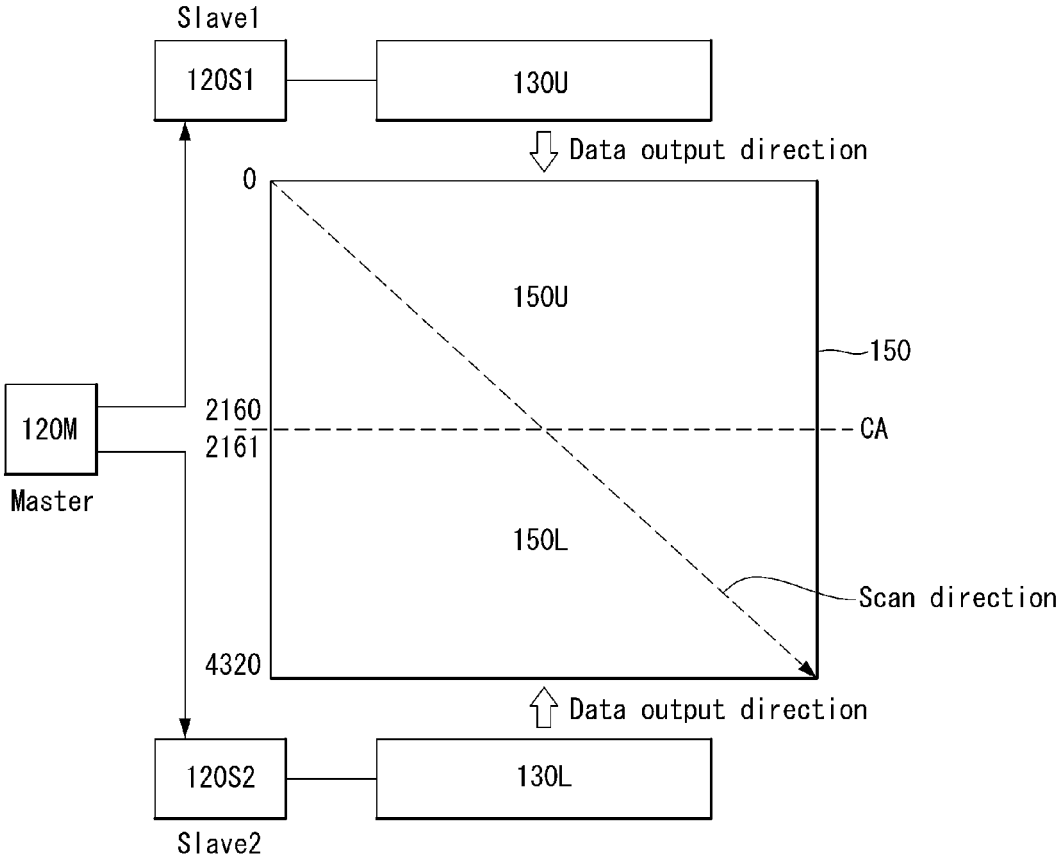
FIG. 17 is an illustration of a configuration of a high-resolution display device according to a third exemplary embodiment of the present invention.

FIG. 17 is an illustration of a configuration of a high-resolution display device according to a third exemplary embodiment of the present invention.

As illustrated in FIG. 17, the high-resolution display device according to the third exemplary embodiment of the present invention comprises at least a single master timing controller 120M, at least two slave timing controllers 120S1 and 120S2, at least two data driver 130U and 130L, and a display panel 150.

The single master timing controller 120M splits and distributes an externally supplied data signal to the two slave timing controllers 120S1 and 120S2, according to the degradation compensation mode. The master timing controller 120M itself splits an externally supplied data signal without using memory according to the degradation compensation mode. The master timing controller 120M is implemented with the configuration explained with reference to the first or second exemplary embodiment. As explained in the first and second exemplary embodiments, a data signal is split into upper and lower regions or into left and right regions with respect to the display surface of the display panel according to the degradation compensation mode.

For example, the first slave timing controller 120S1 supplies to the first data driver 130U data signals corresponding to the upper region 0 to 2160 relative to the central area CA of the display panel 150. The first data driver 130U is disposed on the top of the display panel 150 so as to output data signals to the upper region 150U of the display panel 150.

For example, the second slave timing controller 120S2 supplies to the second data driver 130L data signals corresponding to the lower region 2161 to 4320 relative to the central area CA of the display panel 150. The second data driver 130L is disposed on the bottom of the display panel 150 so as to output data signals to the lower region 150L of the display panel 150.

The display device configured as above may be driven in the order of an image distribution step, an image output step, and an image display step. In the image distribution step, a data signal supplied to one master timing controller is split and distributed to at least two slave timing controllers. In the image output step, the data signals distributed to the at least two slave timing controllers are supplied to at least two data drivers, respectively. In the image display step, the data signals supplied respectively to the at least two data drivers are output to the display panel.

While the master timing controller may be configured as a single unit, the number of slave timing controllers may vary depending on the resolution of the display panel, the control capability of the timing controllers, the number of data drivers, etc. Moreover, while the exemplary embodiments have been described with an example in which the display panel is divided in two: upper and lower regions, other various division methods such as a 4-division method may be employed.

Additionally, the display panel 150 may be scanned in order from the upper to lower regions 0 to 4320. Alternatively, the upper region 0 to 2160 and lower region 2161 to 4320 of the display panel 150 may be scanned simultaneously. Alternatively, the display panel 150 may be scanned in the order (or direction) from the upper region 0 to 2160 to the lower region 2161 to 4320 or vice versa.

As stated above, the present invention has the advantage of providing a control device (timing controller) suitable for implementing a large-screen, high-resolution display device that provides driving and compensation schemes for smoothing out degradation. The present invention has another advantage of resolving inconsistency between split images and maintaining high display quality by varying the method and order in which image data signals are retrieved, depending on the direction in which data signals are shifted in a compensation operation. The present invention has yet another advantage of implementing a large-screen, high-resolution display device without increasing memory.

It will be apparent to those skilled in the art that various modifications and variations can be made in example embodiments of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel configured to display an image;

at least two data drivers configured to supply a data signal to the display panel;

at least two slave timing controllers configured to:

control the at least two data drivers, respectively; and supply the data signal to the at least two data drivers, respectively; and a master timing controller configured to:

control the at least two slave timing controllers;

split an externally supplied data signal; and distribute the split externally supplied data signal to the at least two slave timing controllers, wherein the master timing controller comprises no memory, and wherein the at least two slave timing controllers comprise at least one memory, respectively.

2. The display device of claim 1, wherein the master timing controller is further configured to:

split the externally supplied data signal into at least two;

distribute and output at least two split data signals under control of the split of the externally supplied data signal;

receive a first data signal from the distribution and output of the at least two split data signals; and output the first data signal to one of the at least two slave timing controllers; and receive a second data signal from the distribution and output of the at least two split data signals; and output the second data signal to the other one of the at least two slave timing controllers.

3. The display device of claim 2, wherein the master timing controller is further configured to:

generate a mode control signal according to an internally-configured degradation compensation mode; and split the externally supplied data signal into at least two in response to the mode control signal.

4. The display device of claim 1, wherein the master timing controller is further configured to assign part of the split data signals to one or the other of the at least two slave timing controllers according to the degradation compensation mode.

5. The display device of claim 4, wherein the data signal assigned to one or the other of the at least two slave timing controllers is a variation generated when the input data signal is shifted by a certain distance vertically or horizontally with respect to an origin designated on the display panel according to the degradation compensation mode.

6. A method of driving a display device, comprising:

an image distribution step of splitting a data signal supplied to a master timing controller and distributing the same to at least two slave timing controllers;

an image output step of supplying the data signal distributed to the at least two slave timing controllers to at least two data drivers; and an image display step of outputting the data signal supplied to the at least two data drivers to a display panel, wherein, in the image distribution step, an input data signal is split into at least two according to a degradation compensation mode configured in the master timing controller, and part of the split data signals is assigned to one or the other of the at least two slave timing controllers according to the degradation compensation mode.

7. The method of claim 6, wherein, in the image distribution step, the data signal assigned to one or the other of the at least two slave timing controllers is a variation generated when the input data signal is shifted by a certain distance vertically or horizontally with respect to an origin designated on the display panel according to the degradation compensation mode.

8. The method of claim 6, wherein one of the at least two slave timing controllers writes the split data signal to internal memory, reads the data signal when outputting the same, and inserts black data into the portion from which the data signal is shifted, in the region displayed on the display panel.

9. A timing controller, comprising:

at least two slave timing controllers; and a master timing controller operatively connected to the at least two slave timing controllers, the master timing controller being configured to:

split an externally supplied data signal into at least two;

distribute and output at least two split data signals under control of the master timing controller;

generate a mode control signal according to an internally-configured degradation compensation mode;

split the externally supplied data signal into at least two in response to the mode control signal;

receive a first data signal from the master timing controller;

output the first data signal to one of the at least two slave timing controllers;

receive a second data signal from the master timing controller; and output the second data signal to the other one of the at least two slave timing controllers.

10. The timing controller of claim 9, wherein the master timing controller is further configured to assign part of the split data signals to one or the other of the at least two slave timing controllers according to the degradation compensation mode.

* * * * *